US006364156B1

(12) United States Patent
Smith et al.

(10) Patent No.: US 6,364,156 B1
(45) Date of Patent: Apr. 2, 2002

(54) GOODS DISPENSER

(76) Inventors: Paul C. Smith, P.O. Box 120, Camp Meeker, CA (US) 95419; Thomas L. Nixon, P.O. Box 1200, Occidental, CA (US) 95465

( * ) Notice: Subject to any disclaimer, the term of this patent is extended or adjusted under 35 U.S.C. 154(b) by 0 days.

(21) Appl. No.: 09/523,688

(22) Filed: Mar. 13, 2000

Related U.S. Application Data

(60) Provisional application No. 60/123,764, filed on Mar. 11, 1999.

(51) Int. Cl.[7] ..... A47K 10/24; B65H 1/00
(52) U.S. Cl. ..... 221/46; 221/61; 206/223
(58) Field of Search ..... 221/45, 61, 46; 206/233, 229, 457

(56) References Cited

U.S. PATENT DOCUMENTS 3,089,586 A * 5/1963 Cole ..... 206/233 X
3,307,687 A * 3/1967 Steinman ..... 206/229 X
4,877,154 A * 10/1989 Matsui ..... 221/48 X
4,925,056 A * 5/1990 McCoig ..... 220/404 X
4,928,849 A * 5/1990 Khozai ..... 221/45 X
5,054,612 A * 10/1991 Meyer, Jr. ..... 206/233 X
5,145,062 A * 9/1992 Crispi ..... 206/233 X
5,183,174 A * 2/1993 Quintero ..... 220/404 X
5,246,190 A * 9/1993 Swirkal ..... 248/100 X
5,632,409 A * 5/1997 Raghunanan ..... 221/45 X
5,639,051 A * 6/1997 Surbeck ..... 248/100 X
5,816,440 A * 10/1998 Shields et al. ..... 221/45 X
5,873,643 A * 2/1999 Burgess, Jr. et al. .... 220/404 X
6,109,787 A * 8/2000 Stary ..... 221/45 X

* cited by examiner

*Primary Examiner*—Christopher P. Ellis
*Assistant Examiner*—Gene O. Crawford

(57) ABSTRACT

A goods dispenser adapted particularly for the dispensing of substantially flat flexible goods such as anti-static dryer sheets, napkins, thin protective gloves and the like that also provides for convenient disposal of used goods and other trash. The dispenser comprises a holding means for the goods and a support means for supporting a trash receptacle. In a preferred embodiment, the trash receptacle is a plastic shopping bag and the support means is one or more hooks for engaging the handles of the plastic shopping bag.

3 Claims, 3 Drawing Sheets

GOODS DISPENSER

BACKGROUND OF THE INVENTION

1. Field of the Invention

This invention generally relates to dispensers, and more particularly dispensers allowing one-at-a-time dispensing of dry, substantially flat, flexible goods such as anti-static dryer sheets, napkins, and thin protective gloves.

2. Discussion of the Prior Art

This invention was disclosed in U.S. Provisional Patent 60/123,764, Title: Goods Dispenser, filing date Mar. 11, 1999 by the same inventors.

SUMMARY OF THE INVENTION

Our invention provides a dispenser particularly adapted to allow easy one handed, one-at-a-time dispensing of goods such as sheets of paper-like material, thin protective gloves, and the like. Our Goods Dispenser is particularly useful for goods that are not inter-folded, and therefore will not self-feed out a top opening. In preferred embodiments, our Goods Dispenser includes a provision for trash disposal, with an option of using recycled plastic shopping bags as a receptacle.

The Goods Dispenser bin has an open top through which the goods to be dispensed are loaded into a dispenser bin. The dispenser bin has a back wall and a front wall separated by spaced apart left and right side walls, and a bottom having an opening through which the goods are dispensed. The open top may or may not be fitted with a hinged or removable cover. The bin is preferably sized to accommodate the intended goods either in or removed from the container in which the goods are supplied. The back wall of the bin is adapted for mounting the bin on a convenient vertical surface, having holes for mechanical fasteners, outside surfaces suitable for the application of two-sided adhesive tape fasteners, or other provision, or combination of mounting options.

The opening in the bottom of the bin through which the goods may be withdrawn one at a time is of appropriate shape and size to suit the intended goods. Circular, oval, or elliptical openings are preferred. The opening is large enough to allow easy manual withdrawal of the goods, but small enough so that the surrounding bottom surface adequately supports the remaining supply of goods in the bin as one item of goods at a time is manually withdrawn from the dispenser. The outside surface of the front of the bin is ideal for displaying a logo, promotional information, instructions, cosmetic decoration or the like.

Preferred embodiments of our Goods Dispenser also include a provision for trash disposal that comprises hooks, clips, or other appropriate devices to removable support a trash receptacle. The mounting means may be configured to suspend a plastic shopping bag or support a plastic bin as the trash container.

For example, a preferred embodiment of our Goods Dispenser is specifically designed to accommodate and solve problems associated with storing and dispensing the fabric softener dryer sheets commonly used in home laundries to control the static charges and impart a fragrance to the clothes being dried. Dryer sheets are typically available as single sheets folded and stacked in a rectangular carton. Unlike facial tissues, which are similarly packaged but inter-folded with one another, dryer sheets are single folded. The normal orientation of the carton is with the opening up, and pulling one dryer sheet from the carton does not bring the next sheet into position for dispensing as with facial tissues. Therefore, dispensing sheets from the carton is generally a two handed operation involving holding the carton with one hand while opening the flap of the carton and pulling a sheet out with the other hand. The carton should then be closed to avoid loss of the aromatic fragrance. For lack of a better place, the carton is often left on top of the washer or dryer where workspace is at a premium. Our dispenser, mounted on a nearby vertical surface, provides convenient one handed dispensing of the sheets while reducing the clutter on and around the appliances.

Many home laundry areas are small, and counter, floor and cabinet space is limited. This often results in an inconvenient trash disposal situation. Two particular kinds of trash originate at the dryer used dryer sheets and lint Our Goods Dispenser for dryer sheets is secured by a suitable mounting means to a vertical surface near the dryer such as a wall, closet door, cabinet, or even on a surface of an appliance. This proximity and the design of the Goods Dispenser allows convenient, fast easy one handed dispensing of the sheets without the need to locate, open, close and stow a carton. Hooks may be provided on the dispenser, for example on a skirt extending below the bottom of the bin, from which a polyethylene grocery bag may be suspended, providing very convenient trash disposal for used dryer sheets, dryer lint, and other disposables. The bag in which the trash has been collected can then be quickly removed and neatly disposed of, and another bag may be quickly hung on the dispenser. A fabric bag may be substituted as a cosmetic upgrade from the plastic bag. The visual appearance of this arrangement may be further improved by the provision of a molded plastic trash receptacle as an option to bags.

Our Goods Dispenser is well suited for the storage and dispensing of other goods as well. For example, our Goods Dispenser is well adapted for dispensing the thin protective gloves made of latex, nitrile, and the like commonly used in health care facilities, mechanical repair shops, and many other industries. Unlike the horizontally oriented dispensers commonly employed, our vertically oriented dispenser limits exposure of the gloves to airborne dust and contamination, as only one glove adjacent to the opening in the bottom of the bin is exposed to the atmosphere. Additionally, the remaining gloves gravity feed to the opening, eliminating the "fishing'" for a glove often required with a horizontally oriented dispenser when the supply is dwindling.

BRIEF DESCRIPTIONS OF THE DRAWINGS

The disclosure of dryer sheet cartons, dryer sheets, plastic grocery bags, and hands in the views are for illustrative purposes only and form no part of the claimed invention.

DETAILED DESCRIPTION OF PREFERRED EMBODIMENTS

Figure 1:
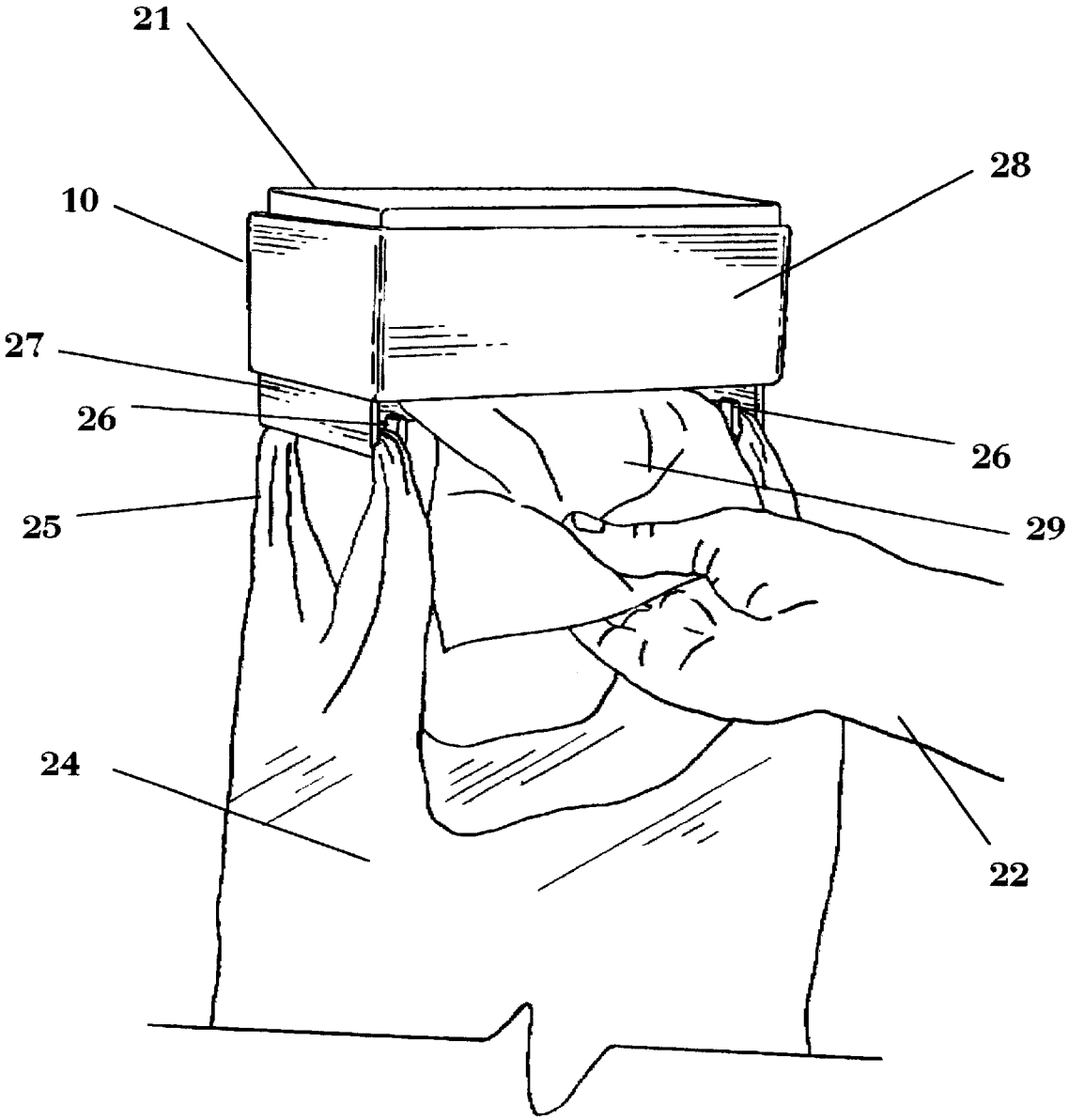
FIG. 1 is a perspective of a preferred embodiment of our Goods Dispenser in use in the intended environment.

FIG. 1 shows a preferred embodiment of our Goods Dispenser 10 in the intended environment. The Goods Dispenser is shown dispensing goods from the carton 21 in which they are supplied. The carton 21, in this example containing sheet goods, is loaded into the Goods Dispenser bin 28 upside down through the open top of the bin. A hand 22 of a user is shown withdrawing a single sheet 29 through an elliptical hole, not seen in this perspective, in the bottom of the bin 28. The back of the bin 28 is configured for mounting on a convenient vertical surface with screws through one or more holes provided, double sided adhesive tape or other mounting methods. In this example a skirt 27 extending below the bin 28 has four hooks 26 for supporting a removable trash receptacle. Two hooks proximal the back wall are not seen in this perspective. Here, the trash receptacle is a recycled plastic shopping bag 24, and the handles 25 the plastic shopping bag are engaged by the hooks 26. The use of four hooks provides a larger opening making trash disposal more convenient.

Figure 2:
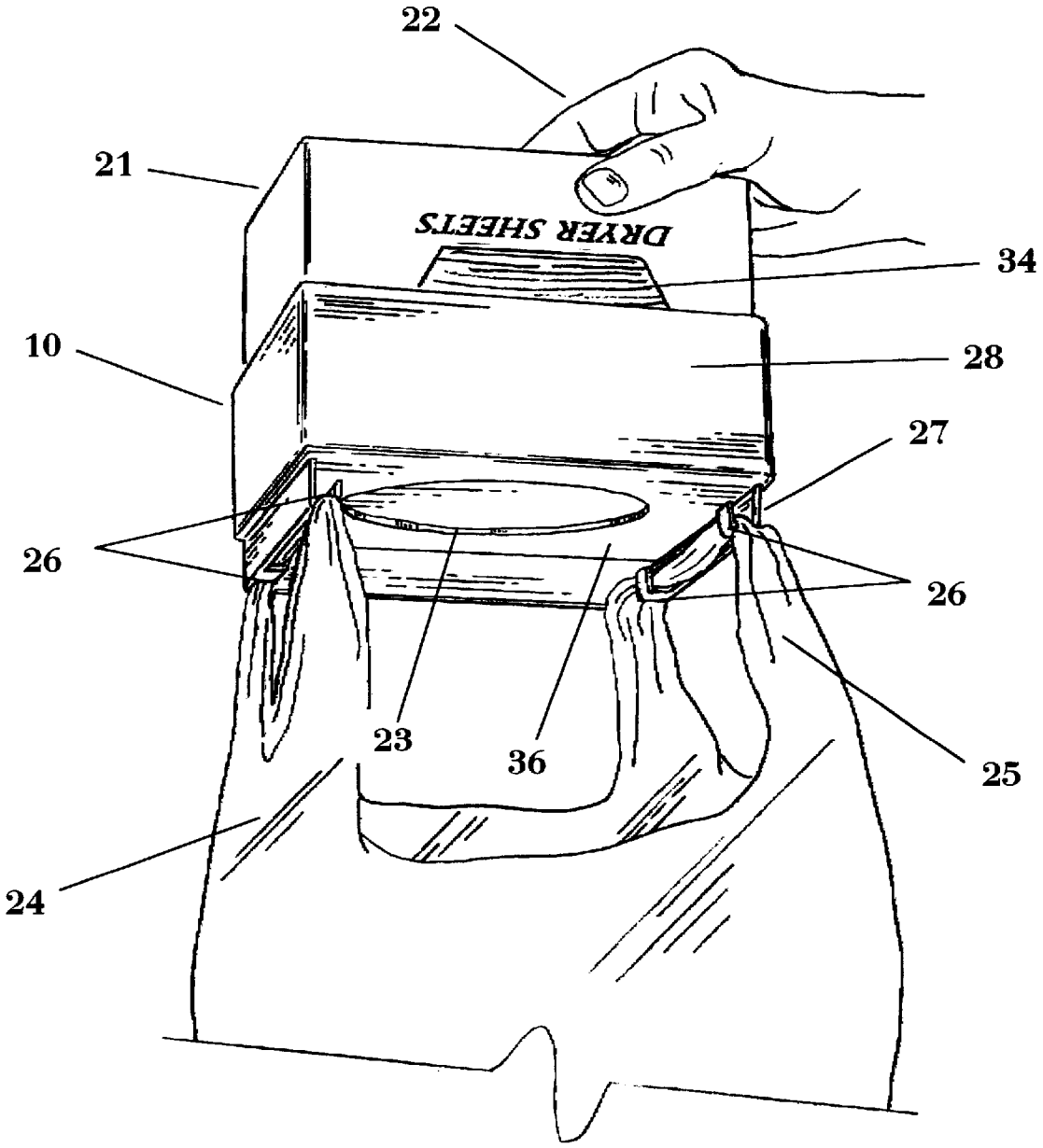
FIG. 2 is a perspective of our Goods Dispenser configured for dryer sheets.

FIG. 2 is a perspective of our Goods Dispenser 10 configured for dryer sheets, shown in the intended environment In this embodiment, the bin 28 is sized to accommodate most dryer sheet cartons now on the market. This results in a bin with inside dimensions of about 7½" long by 4½" wide. Ideally, the carton flap normally opened to access the sheets is tom off and the carton 21 is inverted and placed into the Goods Dispenser bin 28 as the hand 22 illustrated is doing so that the top sheet in the carton is exposed to the opening in the Goods Dispenser bin bottom. A vertical bin depth of about 2 ½" works well for the smaller packages of 20 to 120 sheets, while still having sufficient depth to substantially enclose the stacked dryer sheets 34 when the carton flap of larger units, of 160 sheets for example, is removed. This degree of enclosure substantially protects the dryer sheets from the atmosphere and thus from significant loss of their aromatic fragrance. The opening 23 is large enough to allow easy manual withdrawal of the goods, but small enough so that the surrounding bottom surface 36 adequately supports the remaining supply of sheets in the bin as one sheet at a time is manually withdrawn from the dispenser. Here, four hooks 26 on a skirt 27 depending from the bin are shown as support means for a trash receptacle bag 24.

Figure 3:
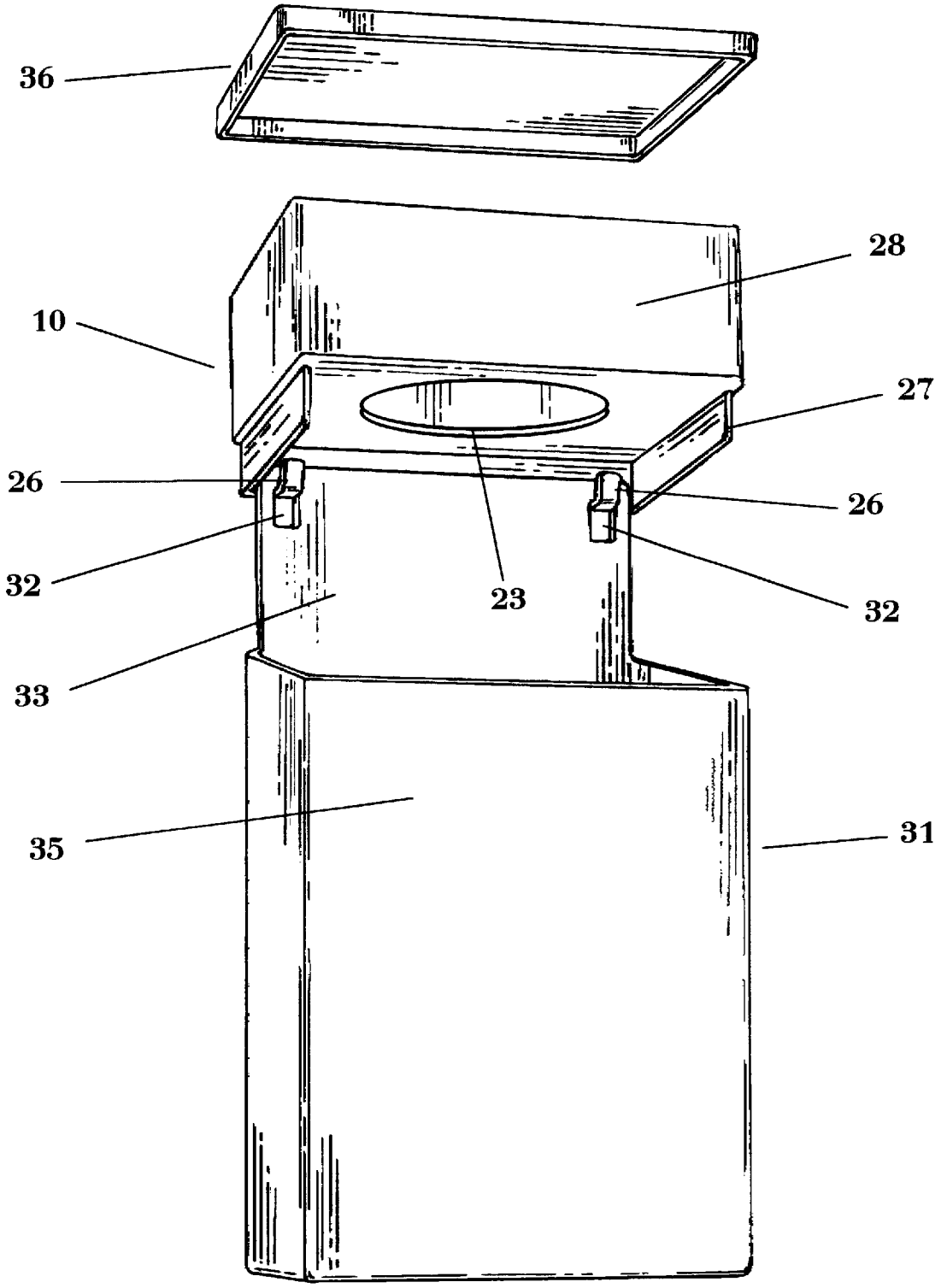
FIG. 3 is a perspective of our Goods Dispenser with a molded plastic trash receptacle.

FIG. 3 is a perspective of our Goods Dispenser 10 fitted with a molded trash receptacle 31 that provides a more refined appearance than the bag 24 described in FIG. 1 and FIG. 2. Hooks 26 on a skirt 27 depending from the Goods Dispenser bin 10 engage openings 32 in the back 33 of the molded trash receptacle 31 so that it can be removably suspended from the sheet Goods Dispenser in place of a bag. In this example, the back 33 extends above the molded trash receptacle 35 to provide adequate clearance below the opening 23 of the dispenser for easy dispensing. This arrangement provides convenient disposal of used goods as well as other sundry trash. Our vertically orientated Goods Dispenser is inherently more protective of the goods than a horizontally orientated dispenser where the goods can fall inwardly away from the opening, exposing the remaining contents to the atmosphere. However, a movable cover 36, if provided, would nearly eliminate loss of fragrance of aromatic goods such as dryer sheets and limit contact with airborne dust and contamination to only an area of the item of single item of goods adjacent the bottom opening. The cover could be completely removable as shown, or hinged to the Goods Dispenser bin 28. The front outer surface of the bin 28 provides an ideal space for logos and other decorative or informative artwork. The front outer surface of the molded trash receptacle 35 provides additional display space for logos and other decorative or informative art work.

Thus, embodiments of our Goods Dispenser have been shown and described. Though certain examples and advantages have been described, other modifications and new advantages may become apparent to those skilled in the art from the disclosures herein. Therefore, the invention is not to be limited except in the spirit of the claims that follow.

We claim:

1. A goods dispenser particularly adapted for dispensing substantially flat, flexible goods, the goods dispenser comprising a holding means for the goods and a support means for engaging the handles of a plastic shopping bag for removably supporting the plastic shopping bag as a trash receptacle wherein the holding means comprises a back wall adapted for mounting the dispenser on a vertical surface, a front wall separated from the back wall by spaced apart left and right side walls, and a bottom wherein the bottom has an opening through which the goods can be dispensed.

2. A goods dispenser for dispensing single folded anti-static dryer sheets comprising a holding means for the sheets and a support means for a trash receptacle wherein the holding means comprises a back wall adapted for mounting the dispenser on a vertical surface, a front wall separated from the back wall by spaced apart left and right side walls, and a bottom, wherein the bottom has an opening through which the goods can be dispensed.

3. A goods dispenser particularly adapted for dispensing substantially flat, flexible goods, comprising a holding means for the goods and a support means for a trash receptacle wherein the holding means comprises a back wall adapted for mounting the dispenser on a vertical surface, a front wall separated from the back wall by spaced apart left and right side walls, and a bottom, wherein the bottom has an opening through which the goods can be dispensed.

* * * * *